US008689858B2

(12) United States Patent
Rothenhöfer et al.

(10) Patent No.: US 8,689,858 B2
(45) Date of Patent: Apr. 8, 2014

(54) COOLER BLOCK, ESPECIALLY FOR A CHANGE AIR COOLER/COOLANT COOLER

(75) Inventors: Horst Rothenhöfer, Lauffen (DE); Wolfgang Ruppel, Bad Liebenzell (DE); Günther Schmalzried, Korb (DE)

(73) Assignee: Behr Industry GmbH & Co. KG, Stuttgart (DE)

( * ) Notice: Subject to any disclaimer, the term of this patent is extended or adjusted under 35 U.S.C. 154(b) by 1333 days.

(21) Appl. No.: 10/574,846

(22) PCT Filed: Oct. 8, 2004

(86) PCT No.: PCT/EP2004/011278

§ 371 (c)(1),
(2), (4) Date: Feb. 21, 2007

(87) PCT Pub. No.: WO2005/036082

PCT Pub. Date: Apr. 21, 2005

(65) Prior Publication Data

US 2007/0209785 A1 Sep. 13, 2007

(30) Foreign Application Priority Data

Oct. 9, 2003 (DE) ..... 103 47 677

(51) Int. Cl.
*F28F 3/06* (2006.01)

(52) U.S. Cl.
USPC ..... 165/166

(58) Field of Classification Search
USPC ..... 165/166
See application file for complete search history.

(56) References Cited

U.S. PATENT DOCUMENTS

| | | | | |
|---|---|---|---|---|
| 2,899,177 | A | 8/1959 | Harris et al. | |
| 3,262,496 | A * | 7/1966 | Bawabe | 165/166 |
| 3,486,489 | A * | 12/1969 | Huggins | 165/183 |
| 3,517,731 | A | 6/1970 | Rothman | |
| 3,601,185 | A | 8/1971 | Rothman | |
| 4,139,054 | A * | 2/1979 | Anderson | 165/166 |
| 4,183,403 | A * | 1/1980 | Nicholson | 165/166 |
| 4,276,927 | A * | 7/1981 | Foust | 165/166 |
| 4,804,041 | A * | 2/1989 | Hasegawa et al. | 165/166 |
| 6,019,169 | A | 2/2000 | Ruppel et al. | |
| 6,035,928 | A | 3/2000 | Ruppel et al. | |
| 6,446,710 | B2 | 9/2002 | Beeck et al. | |
| 6,453,988 | B1 | 9/2002 | Nakado et al. | |
| 6,520,252 | B1 | 2/2003 | Bizzarro | |
| 7,500,515 | B2 * | 3/2009 | Tsuji et al. | 165/183 |

FOREIGN PATENT DOCUMENTS

| | | | |
|---|---|---|---|
| DE | 3606334 | C2 | 9/1987 |
| DE | 3818413 | A1 | 12/1989 |
| DE | 196 44 586 | A1 | 4/1998 |
| DE | 196 51 625 | A | 6/1998 |

(Continued)

*Primary Examiner* — Leonard R Leo
(74) *Attorney, Agent, or Firm* — Muncy, Geissler, Olds & Lowe, P.C.

(57) ABSTRACT

A soldered cooler block, especially for a charge air cooler/coolant cooler, is constructed in a packet-type manner. Cooling channels for a liquid coolant are arranged in the cooler block in a crossways manner in first layers, and gas channels for a gas which is to be cooled are arranged in a crossways manner in second layers. The cooling channels are respectively formed by two wall areas which are arranged at a distance and by intermediate strips and connection strips that include groove profiles.

13 Claims, 1 Drawing Sheet

(56) References Cited

FOREIGN PATENT DOCUMENTS

| | | | |
|---|---|---|---|
| DE | 19900970 | A1 | 7/2000 |
| DE | 10036133 | A1 | 2/2001 |
| DE | 19963374 | A1 | 7/2001 |
| DE | 202 08 748 | U1 | 11/2003 |
| EP | 0 292 968 | A1 | 11/1988 |
| EP | 0 336 407 | A1 | 10/1989 |
| GB | 1 214 219 | A | 12/1970 |

* cited by examiner

COOLER BLOCK, ESPECIALLY FOR A CHANGE AIR COOLER/COOLANT COOLER

FIELD OF THE INVENTION

The invention relates to a cooler block, especially for a charge air cooler/coolant cooler of packet design. A cooler block of this type has been disclosed by the applicant in DE-A 196 51 625.

BACKGROUND OF THE INVENTION

Charge air coolers of what is referred to as packet design are used in particular in large engines where the charge air is cooled by a liquid coolant. These charge air coolers are produced and brazed in a design made totally from aluminum, the cooler block of cuboidal design and the associated connecting branches for the charge air and the coolant being produced separately. The cooler block comprises a multiplicity of plates which are layered on one another and between which strips for forming flow passages and for spacing are arranged. The ready stacked block is then brazed in a brazing furnace. The flow passages for the charge air have corrugated fins or turbulence inserts in the interior, in order to improve the transfer of heat and to increase the internal compressive strength. The cooling passages have a smaller flow cross section than the charge air passages and are bounded by intermediate strips and outer terminating strips. The transfer of heat between coolant and charge air takes place in cross current, i.e. the coolant passages and charge air passages run perpendicularly to one another. A charge air cooler of this type has been disclosed by the applicant in DE-A 196 51 625 mentioned above. In the case of the known charge air cooler, the cooling passages for the liquid coolant have a rectangular cross section, since the intermediate strips arranged between the adjacent plates likewise have a rectangular cross section. A problem with these heat exchangers are the unsteady states, in particular on the charge air side, which, due to sharp changes in temperature with high temperature differences and temperature peaks, lead to the coolant overheating, i.e. to the boiling point being exceeded locally with steam bubbles being formed. It is absolutely to be avoided.

A similar heat exchanger of packet design, likewise a charge air cooler, has been disclosed by the applicant in DE-C 196 44 586. The difference in this case are the cooling passages which are formed by a plate-like extruded profile. The passage cross sections are rectangular or oval, but this is primarily for manufacturing reasons (extrusion).

SUMMARY OF THE INVENTION

It is the object of the present invention to improve a cooler block of the type mentioned at the beginning in such a manner that local overheating occurrences are avoided as far as possible.

According to the invention, the intermediate and/or terminating regions of the cooling passages, which regions are designed in particular as strips, are provided on their coolant sides with a grooved profile. This grooved profile results in a rounding of the rectangular cross section on its narrow side.

Under some circumstances, local occurrences of overheating may occur in the corner regions of rectangular passage cross sections. Such overheating is advantageously largely avoided by the rounding according to the invention of the passage cross section by means of the grooved profile.

The grooved profile results, firstly, in evened-out flow conditions in the coolant passage and, secondly, in a thermal load alleviation at the critical corner regions. Furthermore, the introduction of heat from the hot gas into the coolant flowing in the cooling passage is distributed over a relatively large area. Local boiling with harmful formation of steam bubbles in the coolant is therefore also avoided.

A design is made possible by means of a stacking design according to an advantageous embodiment, with profiled bars being used, in which simple components, such as plates and strips, can be used.

An integral design of the cooling passages according to another embodiment brings about the advantage of a simple design with a low number of individual parts.

According to an advantageous refinement of the invention, the grooved profile has a parabolic cross section which is bounded on both sides by profiled strips which are brazed to the adjacent plate. This cross section constitutes a favorable compromise in terms of strength and flow.

According to another advantageous refinement of the invention, the grooved profile has a V-shaped cross section, i.e. a certain simplification in terms of manufacturing in comparison to the parabolic profile.

According to a further refinement of the invention, the profile of an intermediate strip is designed approximately as an H profile, i.e. with approximately U-shaped indentations on each coolant side.

BRIEF DESCRIPTION OF THE DRAWINGS

An exemplary embodiment of the invention is illustrated in the drawing and is described in more detail below. In the drawing

DETAILED DESCRIPTION

Figure 1:
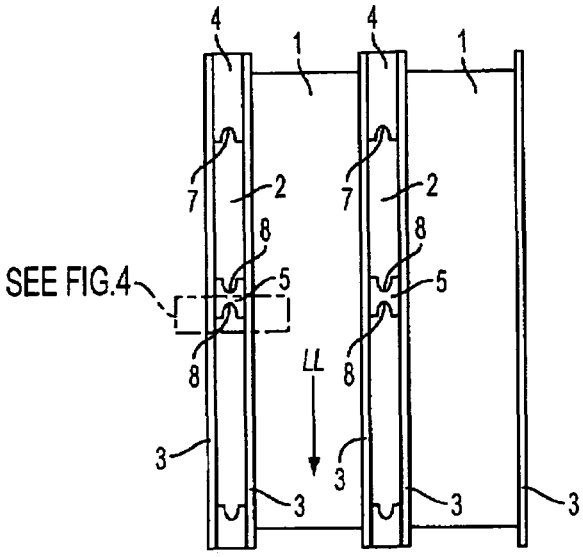
FIG. 1 shows a cut-out of a charge air cooler.

FIG. 1 shows a cut-out of a cooler block (not illustrated at all) with charge air coolers 1 and cooling passages 2 which run transversely with respect thereto and are formed by plates 3 arranged parallel to one another. The charge air passages 1 have charge air flowing through them in the direction of the arrow LL and generally have corrugated fins which are not illustrated here but are known from the prior art. The outer cooling passages 2 are formed, on the one hand, by adjacent plates 3 and, on the other hand, by a respective terminating strip 4 and a respective intermediate strip 5. Further cooling passages 2 (not illustrated) which are arranged on the inside are only bounded by intermediate strips 5. The intermediate strips and the terminating strips are designed as profiled bars 4, 5 and respectively have on their coolant side, that is the side which is wetted by the coolant, a groove 7 and a groove 8, i.e. grooved profiles running in the longitudinal direction of the strips. The cooling passages 2 are therefore somewhat rounded on their narrow sides, as a result of which the wetted circumference of the passage cross section increases and an evened-out admission of heat from the charge air passages 1 takes place. The profiled bars 4, 5 are, as usual, brazed to the plates 3 and can preferably be produced as extruded profiles.

Figure 2:
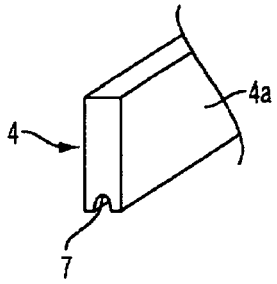
FIG. 2 shows a terminating strip.

FIG. 2 shows an individual illustration of the terminating strip 4 which has the grooved profile 7 on just one side, i.e. the coolant side. The flat side 4*a* is brazed.

Figure 3:
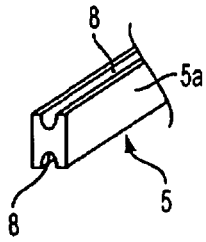
FIG. 3 shows an intermediate strip.

FIG. 3 shows an individual illustration of the intermediate strip 5 which has two grooved profiles 8 on opposite coolant sides. The flat side 5*a* is brazed.

Figure 4:
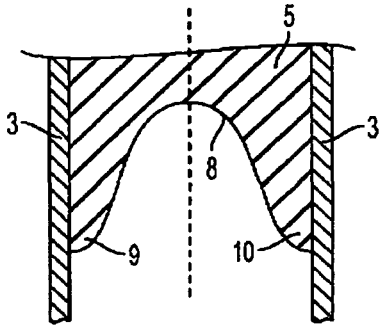
FIG. 4 shows a detail X from FIG. 1.

FIG. 4 shows a detail X from FIG. 1, i.e. the profiled bar 5 (half of which is illustrated) with the approximately parabolic grooved profile 8 which is surrounded laterally by two rounded profiled strips 9, 10 which, for their part, are brazed to the plates 3.

Slight modifications of the grooved profile which is illustrated in the drawing and has approximately a parabolic cross section are possible, for example as a V profile or a H profile.

The invention claimed is:

1. An all-aluminum cooler block for a charge air cooler/coolant cooler of packet design, in which cooling passages, having a length, for a liquid coolant are arranged in first layers, and gas passages including corrugated fins for a gas to be cooled are arranged crosswise in second layers the cooling passages in each case being formed by two spaced apart wall regions and intermediate regions and terminating regions between the wall regions, wherein at least one intermediate or terminating region of the cooling passages has, on its side which is wettable by the coolant, a grooved parabolic profile running in the longitudinal direction of the cooling passages, said grooved parabolic profile being centrally disposed between said two spaced-apart wall regions, wherein the intermediate regions have an approximately H-shaped cross section.

2. The cooler block as claimed in claim 1, wherein the first and second layers are formed by alternating stacking above one another of plates and intermediate and terminating strips, with at least one intermediate or terminating strip being designed as a profiled aluminum bar having a grooved profile running in the longitudinal direction.

3. The cooler block as claimed in claim 1, wherein wall regions and intermediate or terminating regions are formed integrally with one another.

4. The cooler block as claimed in claim 1, wherein the grooved parabolic profile is surrounded by two profiled strips.

5. A cooler block for a charge air cooler/coolant cooler of packet design comprising:

a first plurality of cooling passages for a liquid coolant running in a first direction, each of said first plurality of passages having a length and comprising first and second spaced apart metal wall portions;

a second plurality of cooling passages for a gas to be cooled running in a second direction approximately perpendicular to said first direction, each of said second plurality of passages having corrugated fins and first and second ends and a length between said first and second ends and being defined in part by the first and second metal wall portions of said first plurality of cooling passages;

first and second metal terminating members in each of said first plurality of cooling passages spacing apart said first and second wall portions of each of said first plurality of cooling passages adjacent said first and second ends of said second plurality of cooling passages, said first and second metal terminating members each including a parabolic groove in a surface wettable by the liquid coolant, said parabolic groove of said first metal terminating member facing said parabolic groove of said second metal terminating member; and at least one metal intermediate member spacing apart said first and second wall portions between said first and second terminating members, said at least one metal intermediate member including first and second opposed parabolic grooves facing toward said first terminating member and said second terminating member.

6. The cooler block as claimed in claim 5, wherein said metal terminating member comprises a brazeable metal terminating member.

7. The cooler block as claimed in claim 1, wherein the first and second parabolic grooves in said at least one metal intermediate member have a size and a shape that is the same as a size and a shape of the parabolic grooves in the first and second metal terminating members.

8. The cooler block as claimed in claim 5 wherein said first metal terminating member has an end edge and wherein said first parabolic groove of said first metal terminating member is centered in said end edge and is spaced from said first and second wall portions by first and second end edge portions of said first metal terminating member end edge.

9. The cooler block as claimed in claim 8, wherein said at least one metal intermediate member includes an end edge and wherein said first parabolic groove of said at least one intermediate member is formed in said end edge of said at least one intermediate member and is spaced from said first and second wall portions by first and second end edge portions of said at least one intermediate member end edge.

10. The cooler block as claimed in claim 9, wherein the first and second end edges of the at least one metal intermediate member do not lie on the parabola defined by said first parabolic groove of said at least one metal intermediate member.

11. A cooler block for a charge air cooler/coolant cooler of packet design comprising:

a first plurality of cooling passages for a liquid coolant running in a first direction, each of said first plurality of passages having a length and comprising first and second spaced apart metal wall portions;

a second plurality of cooling passages for a gas to be cooled running in a second direction approximately perpendicular to said first direction, each of said second plurality of passages having corrugated fins and first and second ends and a length between said first and second ends and being defined in part by the first and second metal wall portions of said first plurality of cooling passages; and first and second metal terminating members in each of said first plurality of cooling passages spacing apart said first and second wall portions of each of said first plurality of cooling passages adjacent said first and second ends of said second plurality of cooling passages, said first and second metal terminating members each including a parabolic groove in a surface wettable by the liquid coolant, said parabolic groove of said first metal terminating member facing said parabolic groove of said second metal terminating member, wherein said first metal terminating member has an end edge and wherein said parabolic groove of said first metal terminating member is centered in said end edge and is spaced from said first and second wall portions by first and second end edge portions of said first metal terminating member end edge.

12. The cooler block as claimed in claim 11 wherein said first and second end edge portions do not lie on the parabola defining the first parabolic groove.

13. A cooler block for a charge air cooler/coolant cooler of packet design comprising:

a first plurality of cooling passages for a liquid coolant running in a first direction, each of said first plurality of passages having a length and comprising first and second spaced apart metal wall portions;

a second plurality of cooling passages for a gas to be cooled running in a second direction approximately perpendicular to said first direction, each of said second plurality of passages having corrugated fins and first and second ends and a length between said first and second ends and being defined in part by the first and second metal wall portions of said first plurality of cooling passages; and first and second metal terminating members in each of said first plurality of cooling passages spacing apart said first and second wall portions of each of said first plurality of cooling passages adjacent said first and second ends of said second plurality of cooling passages, said first and second metal terminating members each including a parabolic groove in a surface wettable by the liquid coolant, said parabolic groove of said first metal terminating member facing said parabolic groove of said second metal terminating member, wherein the parabolic groove in the first metal terminating member in a first one of the first plurality of cooling passages includes an axis of symmetry that extends into the parabolic groove of the second metal terminating member in the first one of the first plurality of cooling passages.

* * * * *

UNITED STATES PATENT AND TRADEMARK OFFICE

CERTIFICATE OF CORRECTION

PATENT NO. : 8,689,858 B2
APPLICATION NO. : 10/574846
DATED : April 8, 2014
INVENTOR(S) : Rothenhoefer It is certified that error appears in the above-identified patent and that said Letters Patent is hereby corrected as shown below:

On the Title Page, Item (54) and in the Specification, Column 1, title should read

COOLER BLOCK, ESPECIALLY FOR A CHARGE AIR COOLER/COOLANT COOLER

Signed and Sealed this
Tenth Day of June, 2014

Michelle K. Lee

Michelle K. Lee
*Deputy Director of the United States Patent and Trademark Office*